US010888127B2

(12) United States Patent
Sabag et al.

(10) Patent No.: US 10,888,127 B2
(45) Date of Patent: Jan. 12, 2021

(54) SHAPEWEAR GARMENT FOR DISCRETE BODY CONTOURING

(71) Applicant: Sheer LLC, Calabasas, CA (US)

(72) Inventors: Shir Sabag, Calabasas, CA (US); Tosha Leigh Hays, Cambridge, MA (US)

(73) Assignee: SHEER LLC, Calabasas, CA (US)

( * ) Notice: Subject to any disclaimer, the term of this patent is extended or adjusted under 35 U.S.C. 154(b) by 209 days.

(21) Appl. No.: 15/994,127

(22) Filed: May 31, 2018

(65) Prior Publication Data

US 2019/0364977 A1 Dec. 5, 2019

(51) Int. Cl.
*A41B 9/08* (2006.01)
*A41B 9/16* (2006.01)

(52) U.S. Cl.
CPC *A41B 9/08* (2013.01); *A41B 9/16* (2013.01); *A41B 2400/38* (2013.01)

(58) Field of Classification Search
CPC ..... A41B 9/08; A41B 9/16; A41B 2400/36; A41B 2400/38; A41C 3/08; A41C 3/0014; A41C 1/06; A41C 1/006; A41C 1/12
USPC ..... 450/11, 30
See application file for complete search history.

(56) References Cited

U.S. PATENT DOCUMENTS

| | | | | |
|---|---|---|---|---|
| 7,520,794 | B1 * | 4/2009 | Johnson | A41B 1/22 2/106 |
| 2009/0265830 | A1 * | 10/2009 | Hendrickson | A41D 1/215 2/104 |
| 2010/0184355 | A1 * | 7/2010 | Kennedy | D04B 1/246 450/31 |
| 2014/0273734 | A1 * | 9/2014 | Gordon | A41C 1/06 450/7 |
| 2015/0208734 | A1 * | 7/2015 | Callahan | A41D 27/02 450/30 |
| 2015/0208737 | A1 * | 7/2015 | Nevins | A41D 1/22 2/74 |
| 2017/0296359 | A1 * | 10/2017 | Conway | A61F 2/52 |
| 2018/0035725 | A1 * | 2/2018 | Carlton | A41D 1/22 |

* cited by examiner

*Primary Examiner* — Timothy K Trieu
(74) *Attorney, Agent, or Firm* — David Postolski, Esq.; Gearhart Law LLC

(57) ABSTRACT

Disclosed herein are embodiments for full body garments having wide, abdominal-shaping portions stitched onto an inner shaping liner, and methods of making the same. The garments disclosed herein have wide, abdominal-shaping portions with features constructed to smooth and restrain the garment-wearer's abdominal area, back, and upper hip. The combination of the outer shell, liner, and inner third partial layer create the unique shaping garment.

10 Claims, 3 Drawing Sheets

Any length dress can be constructed with various sleeve lengths and styles as well as neckline styles.

SHAPEWEAR GARMENT FOR DISCRETE BODY CONTOURING

BACKGROUND

Technical Field

This disclosure relates to clothing and, in particular, to shaping garments. This disclosure also relates to methods of assembling the garments disclosed herein.

Background

Garments are designed to cover the wearer's body. The problem exists that garments are not always flattering and do not always offer a smooth, flattering silhouette. The solution disclosed herein is a shaping apparel garment that offers the luxury of an outer garment with the functionality of an innerwear shaping piece.

DETAILED DESCRIPTION

Disclosed herein are embodiments for a shaping apparel dress with two full layers which function as one unit. A third partial interior shaping satin or sateen layer is stitched onto the second liner layer for added shaping and smoothing.

Figure 1:
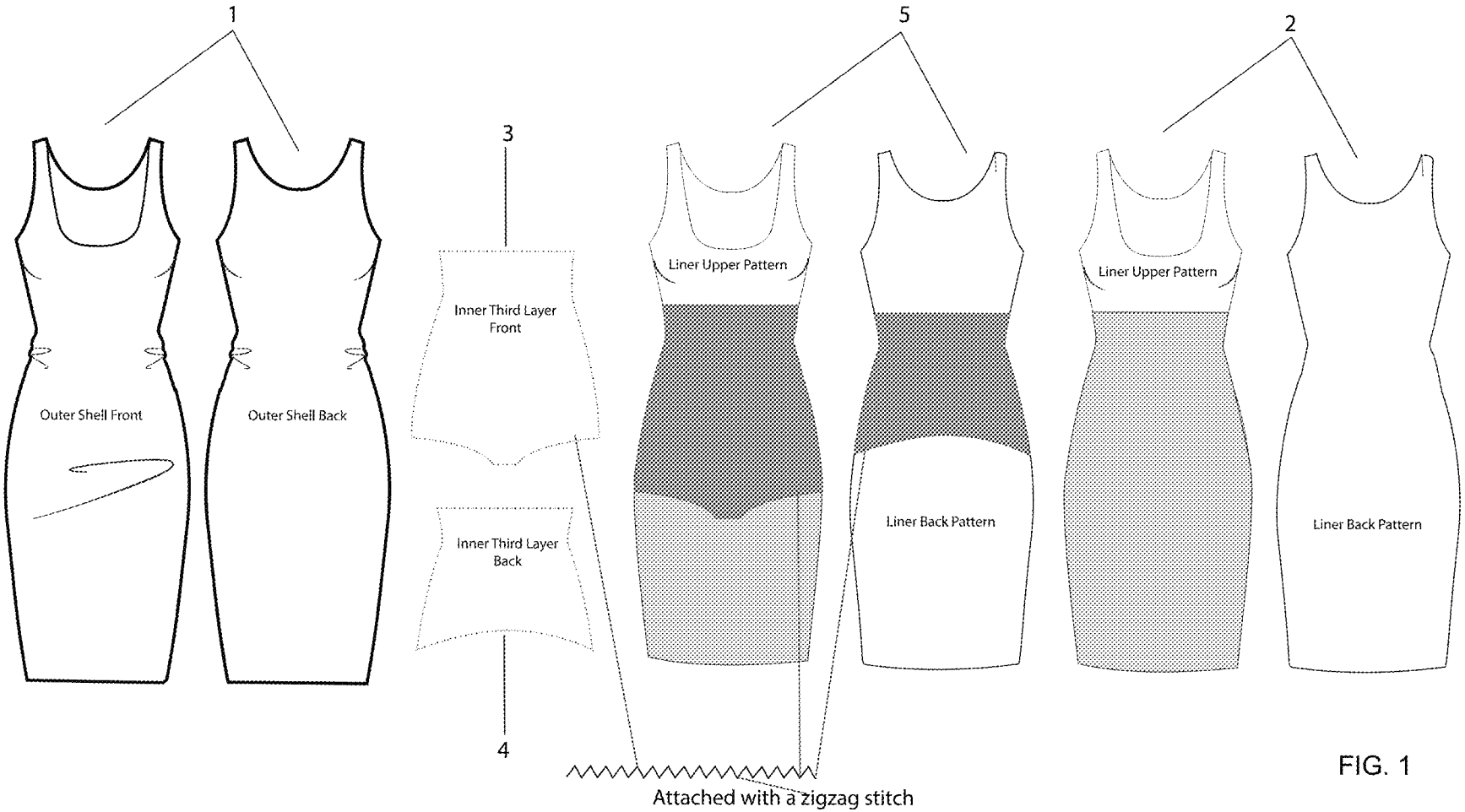
FIG. 1 shows a shaping apparel dress with two full layers which function as one unit, according to an example embodiment.
Figure 3:
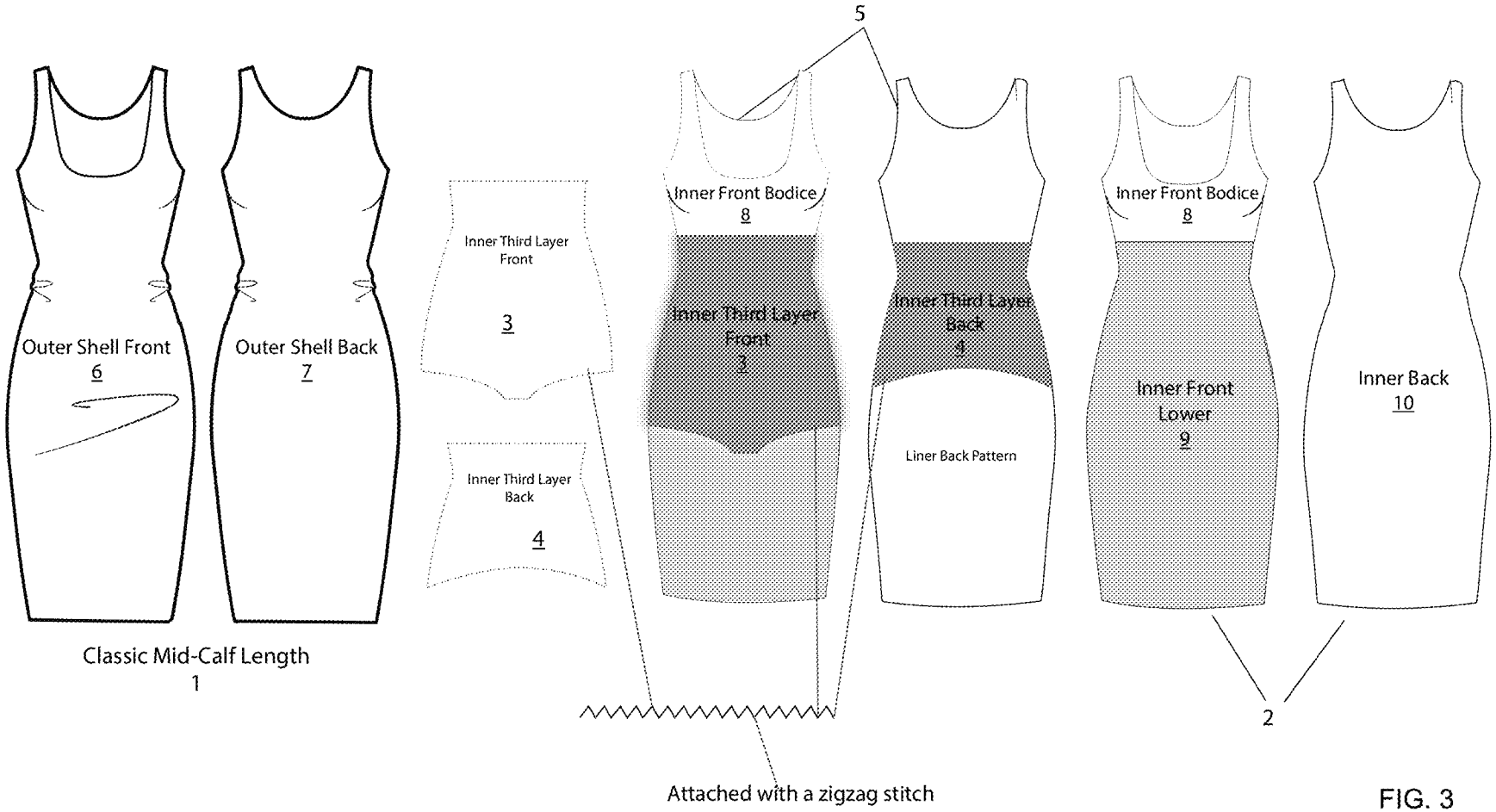
FIG. 3 shows further details of a shaping apparel dress with two full layers which function as one unit, according to an example embodiment.

FIGS. 1 and 3 show a shaping apparel dress with two full layers which function as one unit, according to an example embodiment. In particular embodiments, a shaping dress includes two main layers (1,2) and one interior partial layer (3) stitched to lining (second) layer (2). The dress looks like one single layer but has two layers. Element 5 in FIGS. 1 and 3 illustrates the placement of interior partial layers 3 and 4 with respect to the lining layer (2). Outer layer (1) may be one piece of fabric cut from one front pattern (6) and one back pattern piece (7). It is then sewn to an inner liner made of three pattern pieces—a top bust portion (8), a lower front portion (9), and a back portion (10).

Figure 2:
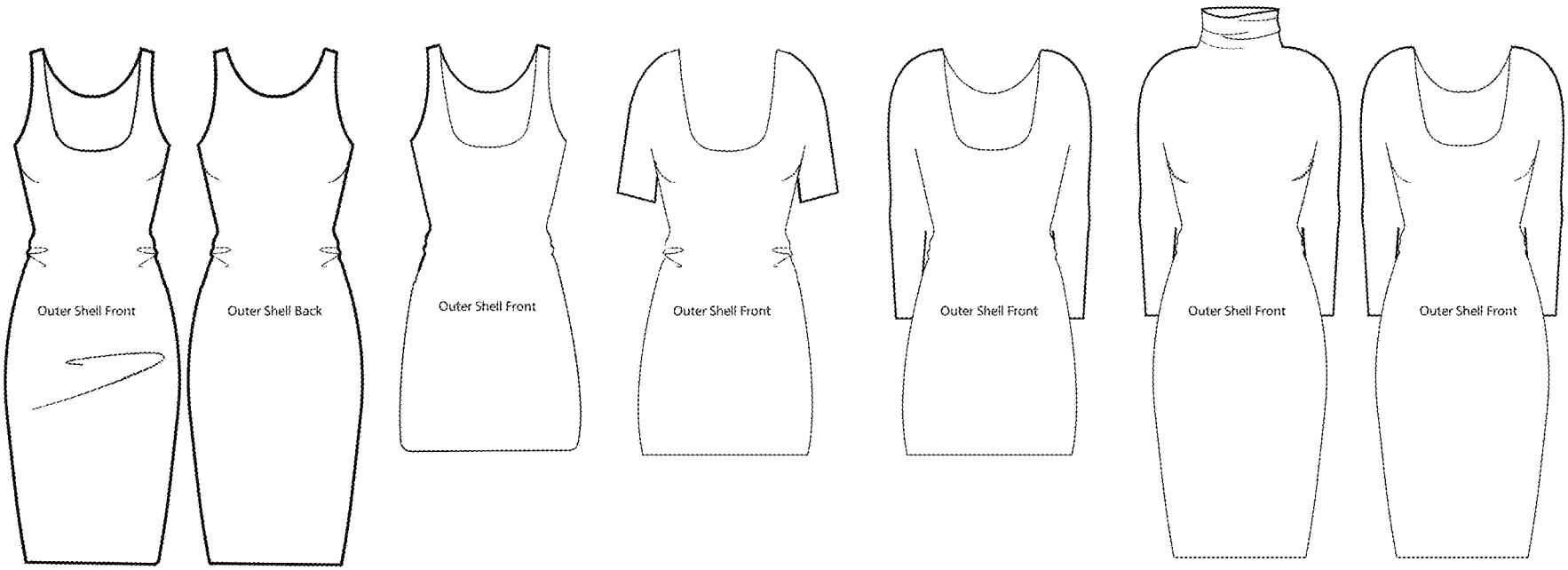
FIG. 2 shows example outer layers of shaping apparel dresses with two full layers which function as one unit, according to example embodiments.

The outer shell (1) may be made of ponte fabric composed of 60% Rayon, 33% Nylon, and 7% Lycra with a weight of 16 ounces but could be made of any combination of cotton, modal, viscose, nylon, polyester, hemp, linen, rayon, spandex, or other natural or man-made fibers. FIG. 2 shows, by way of example and not limitation, multiple possible outer shells (1), including a sleeveless mini dress (13), a short sleeve mini dress (14), a long sleeve mini dress (15), a long sleeve turtleneck classic dress (16), and a long sleeve classic dress (17).

The upper bust inner shell (top bust portion) (8) may be made of jersey fabric composed of 91% Modal, 9% Spandex with a weight of 270 GSM or 92% Rayon, 8% Spandex but could be made of any combination of cotton, modal, viscose, nylon, polyester, hemp, linen, rayon, spandex, or other natural or man-made fibers.

The lower front n and back body (10) may be made of tricot fabric composed of Polyester and Spandex but could be made of any combination of cotton, modal, viscose, nylon, polyester, hemp, linen, rayon, spandex, or other natural or man-made fibers.

The inner front third partial layer (3) may be stitched to the front underbust seam and into the side seams within the seam. The lower portion of the third layer front may be zigzag stitched to the inner liner body. In particular embodiments, the dress may comprise an additional inner back third partial layer (4), which may be stitched within the side seams and along the upper and lower edge to the liner body. The inner third partial layers (3,4) may be made of either polyester/spandex or nylon/spandex satin or sateen fabric. It should be understood that embodiments may include only the inner front third partial layer (3), or both the inner front third partial layer (3) and the inner back third partial layer (4).

An inner third partial layer (3,4) may be made of satin or sateen which shapes the abdomen and lower back area. The satin weave is characterized by four or more fill or weft yarns floating over a warp yarn or vice versa, four warp yarns floating over a single weft yarn. A satin fabric tends to have a high luster due to the high number of floats on the fabric.

Dress Construction

This section describes an example embodiment of a method to fabricate the shapewear garment described above. The outer front pattern piece along with the back pattern piece are cut using the outer shell Ponte fabric. One of each is cut. The inner bust pattern piece is cut using the jersey fabrication. One is cut. The lower inner liner pattern piece and back inner liner pattern piece are cut out of the tricot fabric. One of each is cut. The outer shell is sewn together by overlocking and then pulling the seam (a pull-out stitch) at side seams and shoulder seam. An edgestitch or single needle stitch is then added on top of the pullout stitch to secure the seam. The hem is a 1" double needle cover stitch without the top cover. The inner layer is sewn by first stitching the upper bust to the lower body with a flatlock seam or an overlock seam with the seam allowance towards the body of the wearer. The third partial layer is sewn into the underbust seam and at the lower bottom edge to the front liner. The back third partial layer is stitched to the inner layer back pattern piece at the top and bottom edge with a zigzag machine. The front liner is then sewn to the back liner with a pullout stitch and at this stage the third partial layer is included in the side seam stitching. An edgestitch is then added to the liner side seam pullout stitch to secure the seam. Pull-out stitch may be a "loose" overlock stitch which is then pulled apart to flatten the seam. On top of this seam is stitched a single needled stitch to secure or lock the seam in place. After side seams are stitched together on both shell and liner, each piece is stitched with a flatlock stitch at shoulders. At this point, the shell and the liner are two dresses. The "dresses" (shell and inner liner) are then sewn together in the following way. Turn the shell inside out and place right sides to right sides, aligning the dresses at armhole and neckline. When the dresses are aligned, stitch the neckline front and back; turn the dress and edgestitch on liner side along the neckline seam allowance. Turn the dress back to right sides to right sides. Taking the armhole and grasping the seam allowance from the inside, stitch along the armhole for as far as you can. Repeat on other side. Turn the dress right side out. Hand stitch or machine stitch the armhole opening closed. At this point the dress is one piece.

Hem the outer layer with a 1" double needle cover stitch without the top cover. Hem the inner liner with a 1" single needle or double needle stitch. Construction is then complete.

Unique Qualities of the Sheer Dress

Double layer recipe of specified fabric creates a bulge free smooth silhouette.

Outer shell fabric is uniquely chosen for all weather weight and texture/density hide body imperfections such as cellulite. Inner seams are also well hidden with this fabric.

The bust fabric was chosen so as not to compress or distort breast tissue.

Underbust seam placed such as to offer bust support and lay on body underneath bust.

Liner fabric chosen for its unique compression qualities while not being too thick.

Polyester fabrication chosen as it has natural wicking and quick dry qualities.

Side seams offer flat seaming so as not to show when on body. Pullout stitch also offers a unique decorative and functional quality.

Underbust seam offers support while maintaining invisibility.

Dress is an outerwear, ready-to-wear piece and is not intended to be sold as shapewear undergarments although it functions as shapewear.

Inner liner has a third shaping layer composed of a polyester/spandex or nylon/spandex satin or sateen fabric. This layer is for increased tummy control and to avoid fat bulges in the abdominal and back area.

The combination of the knitting structure, yarn, spandex and cover yarn between shell and liners as well as unique third partial shaping layer offer a unique all in one shaping dress.

The embodiments disclosed above are only examples, and the scope of this disclosure is not limited to them. Particular embodiments may include all, some, or none of the components, elements, features, functions, operations, or steps of the embodiments disclosed above. The dependencies or references back in the attached claims are chosen for formal reasons only. However any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

It is to be appreciated that the Detailed Description section, and not the Summary and Abstract sections (if any), is intended to be used to interpret the claims. The Summary and Abstract sections (if any) may set forth one or more but not all exemplary embodiments of the invention as contemplated by the inventor(s), and thus, are not intended to limit the invention or the appended claims in any way.

While the invention has been described herein with reference to exemplary embodiments for exemplary fields and applications, it should be understood that the invention is not limited thereto. Other embodiments and modifications thereto are possible, and are within the scope and spirit of the invention. Further, embodiments (whether or not explicitly described herein) have significant utility to fields and applications beyond the examples described herein.

References herein to "one embodiment," "an embodiment," "an example embodiment," or similar phrases, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it would be within the knowledge of persons skilled in the relevant art(s) to incorporate such feature, structure, or characteristic into other embodiments whether or not explicitly mentioned or described herein.

The breadth and scope of the invention should not be limited by any of the above-described exemplary embodiments, but should be defined only in accordance with the following claims and their equivalents.

What is claimed is:

1. A shaping garment comprising three fabric layers, the layers comprising:

(a) an outer layer of fabric cut to form one front pattern piece and one back pattern piece;

(b) an inner liner layer cut to form three pattern pieces, the inner liner layer comprising:

a top bust portion, a lower front portion, the lower front portion and top bust portion stitched together at an underbust seam, and a back portion, wherein the outer layer and inner liner layer are stitched along a neckline and arms of the shaping garment; and (c) an inner compression layer made of compression fabric comprising elastane disposed inside the inner liner layer, the inner compression layer comprising a front compression layer and a back compression layer, wherein the inner front compression layer is stitched at the top to an interior side of a front of the underbust seam of the top bust portion of the inner liner layer, the lower front portion and back portion of the inner liner layer are stitched together at one or more side seams and the inner compression layer is included in the one or more side seam stitching, and the compression layer is further stitched at the bottom to an interior side of the lower front and back portions of the inner liner layer.

2. The shaping garment of claim 1, wherein the inner front compression layer is stitched at the bottom to the body of the lower front portion of the inner liner layer using a zigzag stitch.

3. The shaping garment of claim 1, wherein the inner back compression layer is stitched at the bottom to the body of the back portion of the inner liner layer using a zigzag stitch.

4. The shaping garment of claim 1, wherein the outer layer comprises a single piece of fabric.

5. The shaping garment of claim 1, wherein the outer layer is made of ponte fabric comprising rayon, nylon, and elastene.

6. The shaping garment of claim 2, wherein the outer layer comprises 60% rayon, 33% nylon, and 7% elastane.

7. The shaping garment of claim 1, wherein the top bust portion of the inner liner layer is made of fabric comprising modal or rayon, and elastane.

8. The shaping garment of claim 1, wherein the lower front and back portions of the inner liner layer are made of tricot fabric comprising polyester and elastane.

9. The shaping garment of claim 1, wherein the inner compression layer is made of satin fabric comprising polyester or nylon, and elastane.

10. The shaping garment of claim 1, wherein the inner compression layer is made of sateen fabric comprising polyester or nylon, and elastane.

* * * * *